US009333784B2

(12) United States Patent
Faber

(10) Patent No.: US 9,333,784 B2
(45) Date of Patent: May 10, 2016

(54) SELF-INKING STAMP

(71) Applicant: COLOP Stempelerzeugung Skopek Gesellschaft m.b.H. & Co. KG., Wels (AT)

(72) Inventor: Ernst Faber, Wels (AT)

(73) Assignee: COLOP Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 0 days.

(21) Appl. No.: 14/591,061

(22) Filed: Jan. 7, 2015

(65) Prior Publication Data

US 2015/0191033 A1 Jul. 9, 2015

(30) Foreign Application Priority Data

Jan. 8, 2014 (AT) ..... 50008/2014

(51) Int. Cl.

| | |
|---|---|
| ***B41K 1/02*** | (2006.01) |
| ***B41K 1/40*** | (2006.01) |
| ***B41K 1/12*** | (2006.01) |
| ***B41K 1/42*** | (2006.01) |
| ***B41K 1/10*** | (2006.01) |

(52) U.S. Cl.

CPC ... *B41K 1/40* (2013.01); *B41K 1/02* (2013.01); *B41K 1/10* (2013.01); *B41K 1/12* (2013.01); *B41K 1/42* (2013.01)

(58) Field of Classification Search

CPC ..... B41K 1/02; B41K 1/006; B41K 1/36; B41K 1/38; B41K 1/40; B41K 1/42; B41K 1/52; B41K 1/54; B41K 1/04; B41K 1/10; B41K 1/12

See application file for complete search history.

(56) References Cited

U.S. PATENT DOCUMENTS 1,401,436 A 12/1921 Pannier
3,431,845 A * 3/1969 Hooper ..... 101/287

(Continued)

FOREIGN PATENT DOCUMENTS

AT 6470 U1 11/2003
CN 2 908 157 Y 6/2007

(Continued)

OTHER PUBLICATIONS

Austrian Office Action dated Nov. 4, 2014 in Austrian Application No. A 50008/2014 with English translation of the relevant parts.

*Primary Examiner* — Jennifer Simmons
*Assistant Examiner* — Marissa Ferguson Samreth
(74) *Attorney, Agent, or Firm* — Collard & Roe, P.C.

(57) ABSTRACT

A self-inking stamp with a stamp housing, in which a type unit, which is coupled via a turning axle device to an actuating bow that is upwardly and downwardly displaceable relative to the stamp housing, is arranged such that it can be moved between an upper inking position when it is in contact with an ink pad and a lower printing position turned by 180° with the help of a turning mechanism, wherein the type unit includes two type unit parts arranged one within the other, namely an outer and an inner type unit part, wherein the inner type unit part thereof is accommodated in an inner receiving space in the outer type unit part and is releasably connected to the outer, bow-shaped type unit part, wherein the turning axle device includes two separate, outer axle elements, each extending through an opening in a leg of the actuating bow, through a slot in the stamp housing to and into the outer type unit part and being connected thereto.

10 Claims, 7 Drawing Sheets

(56) References Cited

U.S. PATENT DOCUMENTS

| | | | | |
|---|---|---|---|---|
| 4,432,281 | A | 2/1984 | Wall et al. | |
| 4,528,907 | A * | 7/1985 | Davison | 101/219 |
| 5,718,169 | A * | 2/1998 | Faber | 101/105 |
| 6,453,813 | B1 | 9/2002 | Faber | |
| 6,626,105 | B1 | 9/2003 | Linehan | |
| 6,698,344 | B1 | 3/2004 | Faber | |
| 7,520,221 | B2 | 4/2009 | Ameshofer | |
| 7,654,198 | B2 | 2/2010 | Faber | |
| 8,695,496 | B2 | 4/2014 | Ortner | |
| 2004/0255801 | A1 * | 12/2004 | Shih | 101/111 |
| 2006/0000376 | A1 | 1/2006 | Faber | |

FOREIGN PATENT DOCUMENTS

| | | | |
|---|---|---|---|
| DE | 203 09 613 | U1 | 9/2003 |
| WO | 96/16817 | A | 6/1996 |
| WO | 00/21759 | A1 | 4/2000 |
| WO | 00/47420 | A | 8/2000 |
| WO | 2006/079129 | A1 | 8/2006 |
| WO | 2006/079130 | A1 | 8/2006 |
| WO | 2007/128012 | A1 | 11/2007 |

* cited by examiner

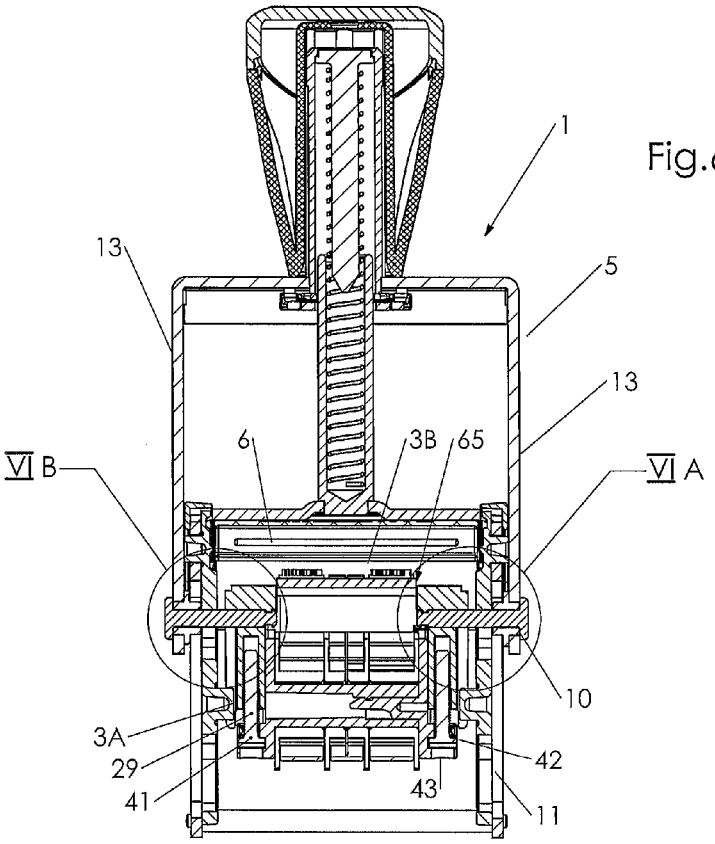
Fig.6
Fig.6B
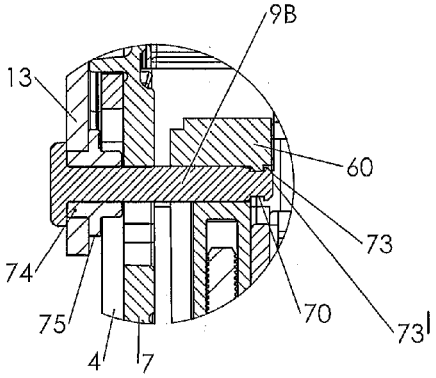
Fig.6A
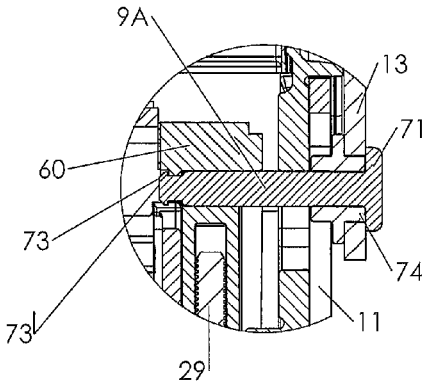

SELF-INKING STAMP

CROSS REFERENCE TO RELATED APPLICATIONS

Applicant claims priority under 35 U.S.C. §119 of Austrian Application No. A 50008/2014 filed Jan. 8, 2014, the disclosure of which is incorporated by reference.

BACKGROUND OF THE INVENTION

1. Field of the Invention

The invention relates to a self-inking stamp with a stamp housing, in which a type unit, which is coupled via turning axle means to an actuating bow that is upwardly and downwardly displaceable relative to the stamp housing, is arranged such that it can be moved between an upper inking position when it is in contact with an ink pad and a lower printing position turned by 180° with the help of a turning mechanism, wherein the type unit comprises two type unit parts arranged one within the other, namely an outer and an inner type unit part, the inner type unit part of which is releasably connected to the outer, bow-shaped type unit part.

2. Description of the Related Art

Such a self-inking stamp, i.e. a hand stamp with a so-called upper-impact inking (the inking is carried out by exertion of pressure from above), is for instance known from WO 2006/079129 A1. The type unit provided in this self-inking stamp comprises a first type unit part, called base part in short, which carries a text plate with stationary text types. Between two laterally outer legs of this base part there is provided a receiving space for a second, inner type unit part which, in the shown example, comprises a bearing part with a support bar for several type bands which are looped in endless loops around drive wheels having adjustment wheels connected for co-rotation therewith. The thus provided variable stamp types are for instance date types, and, consequently, said second type unit part is also termed as a "date basket" or "date holder". Such a type unit with a date holder is a frequent form of a type unit with stationary and variable types, or generally with an outer and an inner type unit part. Further possibilities would for instance be an outer type unit part with a general company name and an inner type unit which will be chosen according to the department of the company and which, consequently, varies. In this known self-inking stamp, as a turning axle means there is provided a one-piece turning axle, usually made of steel, which extends from one bow leg through the type unit to the other bow leg. In this connection, the turning axle extends through both type unit parts and has the object, during making of a stamp imprint when the actuating bow is moved downwards relative to the stamp housing, to displace the entire type unit downwards, and, in doing so, to control the 180° turn of the type unit in cooperation with a turning mechanism part, for instance with pivotable control connecting links, provided within the stamp housing. In this respect, the turning axle is often also referred to as a "control axle". Said construction has proved to be highly efficient, and only different proposals regarding the securing of the turning axle on its ends at the actuating bow have been made, as for instance with the help of sleeve-shaped axle securing parts, see in addition to the above-mentioned WO 2006/079129 A1 in particular also WO 2006/079130 A1. A somewhat simpler axle securing is further disclosed in WO 00/21759 A1.

Furthermore, type units with holding devices for type band inserts are known, wherein at the outside of lateral wall parts thereof axle arms are integrally molded which are coupled to an outer actuating bow and engage into guiding slots in the stamp housing of an associated self-inking stamp; cf. e.g. WO 00/47420 A, but also WO 2007/128012 A1, DE 203 09 613 U1, WO 96/16817 A and CN 2 908 157 Y.

From AT 6470 U1 and U.S. Pat. No. 6,626,105 B1 there are also known simple stamp plate units (without type bands) having laterally molded axle arms which are guided in slots in the stamp housing and are coupled with an actuating bow.

It has turned out that, in a self-inking stamp of the above-mentioned kind with a multi-part type unit, often an exchange of the inner type unit part, in particular of the date holder, is desired or is necessary, for instance for repair and maintenance purposes, or in order to replace said type unit part by another one having other print types. When, at the known self-inking stamp, such a dismounting of the inner type unit part shall be carried out, it is necessary to remove the turning axle extending through the type unit, wherein, therefor, the axle securing elements at the ends have to be detached from their lock position or securing position with the help of special tools. Then the complete type unit is taken out of the stamp housing, and the inner type unit part, which normally is connected to the outer type unit part with the help of screws or bolts, can be dismounted by unscrewing the screws so as to then complete and terminate the exchange by mounting a new inner type unit part or a different inner type unit part. Then the complete type unit has once again to be inserted back into the stamp housing, the continuous turning axle has to be passed through, for which the through-bores in the type unit must be properly aligned with slot openings in the stamp housing as well as with openings in the legs of the actuating bow.

SUMMARY OF THE INVENTION

It is now an object of the invention to propose a solution for the task that an exchange of the inner type unit part, in particular of a date holder, can be performed more easily and rapidly. In particular, said dismounting or exchange shall also be possible without any special tools.

To achieve this object, a self-inking stamp is provided with the features according to the invention. Advantageous embodiments and further developments are discussed below.

Thus, in the present self-inking stamp it is provided in particular that the turning axle means comprise two separate, outer axle elements which, respectively, extend from one leg of the actuating bow through an opening in said leg, through a slot in the stamp housing and to as well as into the outer type unit part and are connected thereto, and that these turning axle means leave an inner receiving space for the inner type unit part.

By the fact that instead of a through-going turning axle just two outer axle elements are provided which rotatably mount the outer type unit part on the actuating bow, the inner type unit part is freed with respect to the turning axle means, i.e. it is only connected to the outer type unit part, for instance via usual screws or bolts, and, thus, can be detached therefrom in a simple manner without the turning axles having to be removed. In this connection, the dismounting of the inner type unit part can be performed simply by unscrewing the screws—which connect the inner type unit part, e.g. the date holder, with the outer type unit part, in particular with a stationary type plate—, and this in the resting position of the self-inking stamp, from the bottom side of the stamp housing.

For a simple mounting of the axle elements from the outside by passing the axle elements through an opening in the actuating bow as well as through a bearing opening in the outer type unit part it is advantageous if the axle elements have—or if at least one axle element has—an outer radial stop projection by means of which the (respective) axle element abuts externally at the leg of the actuating bow. Here, the stop projection may simply be formed by a collar or a shoulder at the axle element.

On the other hand, for a simple mounting of the axle element or of the axle elements, it is advantageous if at least one axle element, preferably each of the two axle elements, in the region of its inner end, is—snappingly—engaged with the outer type unit part. Furthermore, for the securing of the axle element(s) it is particularly advantageous if the axle element or each axle element, in the region of its inner end, is secured to the outer type unit part by means of a retaining washer accommodated in an annular groove in the axle element, said retaining washer abutting at the inside of the outer type unit part.

By the above-mentioned snap-in connection or by the securing with the help of the retaining washer, a releasable fixing of the respective axle element in the operating position is achieved, wherein only a minimum of space is required therefor, and, hence, sufficient space for the accommodation of the inner type unit part remains guaranteed.

On the other hand, it is also advantageous if at least one axle element, at its inner end, has a radial stop protection abutting at the inside of the outer type unit part; also here, the stop projection can simply be formed by an annular collar or shoulder. In this connection, the stop projection or the collar can be received in a recess in the body of the outer type unit part so as to leave enough space for the accommodation of the inner type unit part.

In particular in the latter case of the abutment of the axle element(s) at the inside of the outer type unit part with the help of a stop projection or a collar, it is further beneficial if, for the securing of the axle, at least one axle element is secured at its outer end by means of a retaining ring abutting externally at the leg of the actuating bow and being received in an annular groove in the axle element. Here, the retaining ring can also be provided in connection with a bearing bush for the axle element or for each axle element, as is known per se from the documents mentioned at the beginning.

As has already been explained, the outer type unit part can comprise stationary print types, in particular text data, as for instance "Received on"; on the other hand, as already mentioned, the inner type unit part is preferably a data holder, i.e. a type unit part with at least one adjustable type band, preferably with several adjustable type bands, in the case of a date stamp in particular with four adjustable type bands, as is known per se.

BRIEF DESCRIPTION OF THE DRAWINGS

In the following, the invention will be explained in more detail by way of particularly preferred exemplary embodiments, to which, however, the invention is not restricted, and with reference to the drawing wherein:

FIGS. 6, 6A, 6B as well as FIGS. 7, 7A, 7B show, in views similar to those in FIGS. 5, 5A, 5B, two modified embodiments with respect to the arrangement of the axle elements in the present self-inking stamp.

DETAILED DESCRIPTION OF PREFERRED EMBODIMENTS

Figure 1:
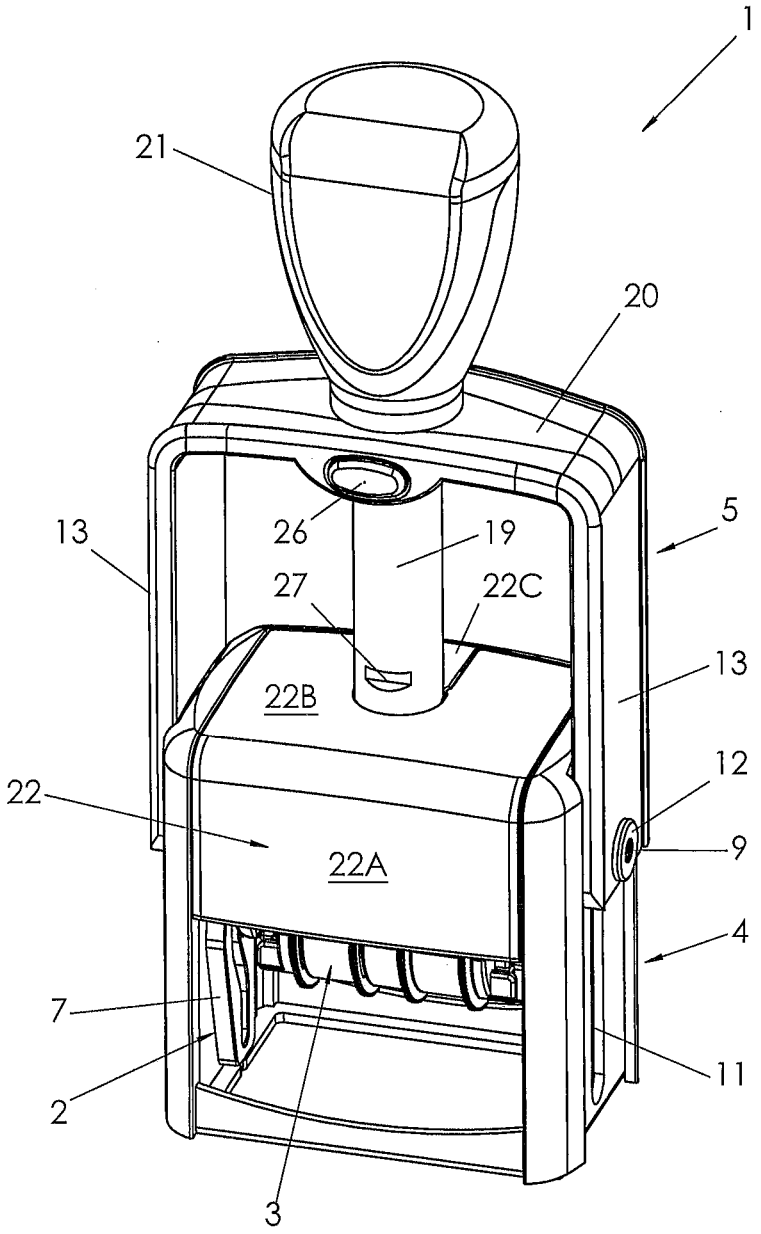
FIGS. 1 and 2 show perspective views of a self-inking stamp with a type unit comprising several type bands, viewed from two different sides.
Figure 2:
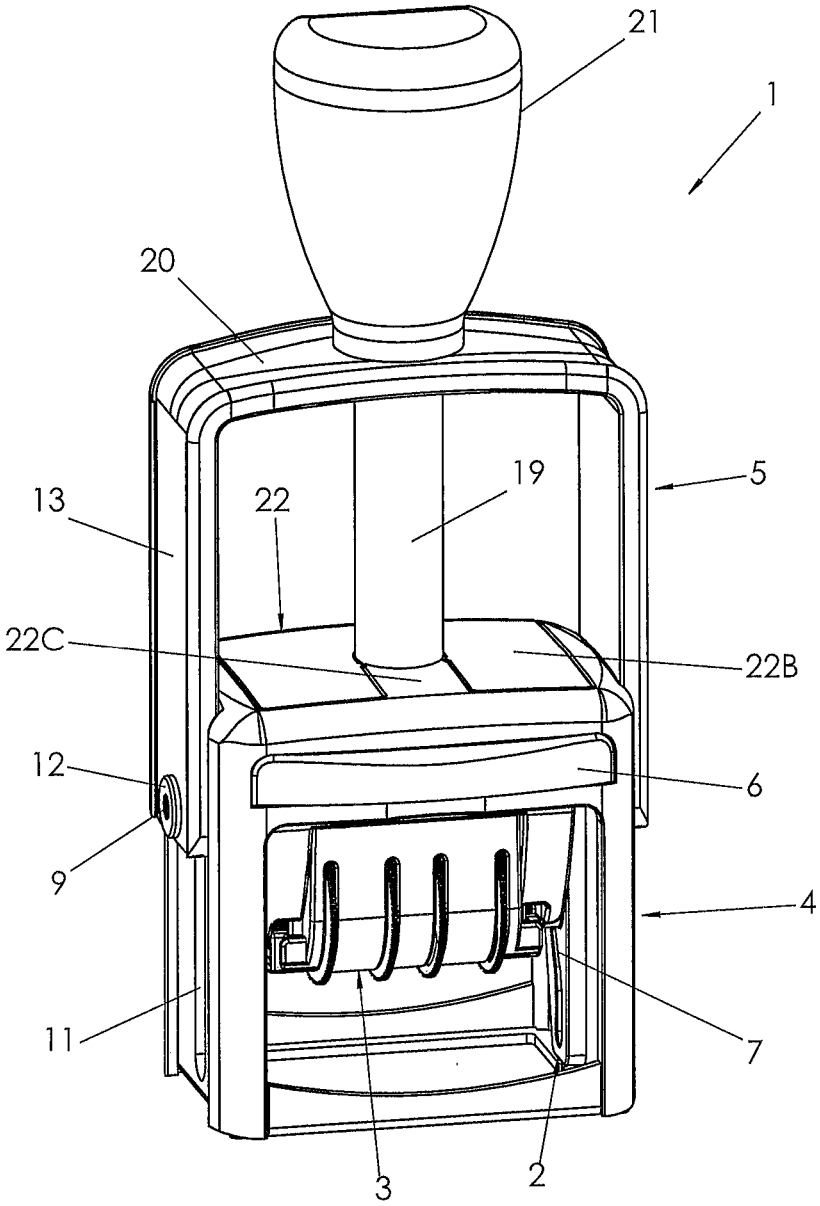
Figure 3:
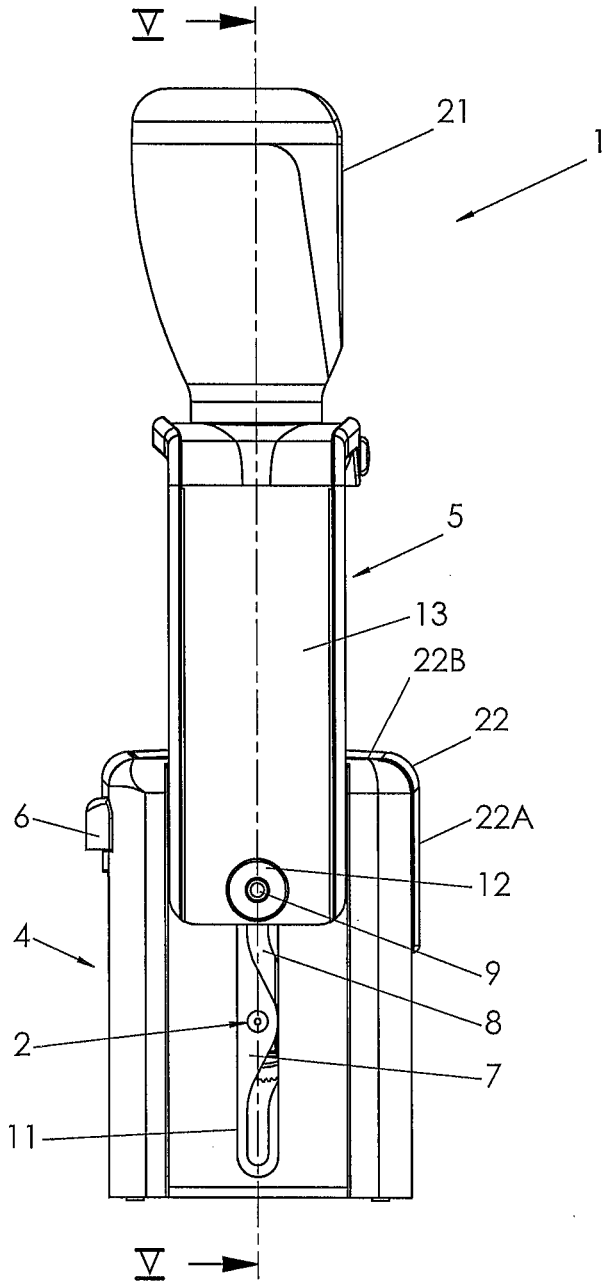
FIG. 3 shows a side view of this self-inking stamp.

In FIGS. 1 to 3, a self-inking stamp 1 with upper inking and having a per se common basic construction and function is illustrated, said self-inking stamp 1 comprising a turning mechanism 2 for a stamp type unit 3. By means of an actuating bow 5, the type unit 3 can be moved upwards and downwards in a stamp housing 4, and, in doing so, can be moved by 180° starting from an upper resting position or inking position as illustrated in FIG. 1 and FIG. 2, in which the stamp types (not visible in FIGS. 1 to 3, yet cf. FIGS. 5, 6, and 7) contact an ink pad soaked with stamping ink within a drawer-like container 6 which can be pushed into and out of the stamp housing 4, into a lower, 180° back-turned printing position. The turning mechanism 2 is of a construction known per se, cf. for instance U.S. Pat. No. 1,401,436 A or U.S. Pat. No. 4,432,281 A, and has rocker-shaped control cranks or control connecting links which are pivotably mounted on the upper end, i.e. turning parts 7 having a curved control slot 8 for turning axle means 9. In the assembled state, said turning axle means 9 extend through openings 10 (see FIG. 6) in the legs 13 of the actuating bow 5 as well as through longitudinal slots 11 in the stamp housing 4, and they are connected to the type unit 3. According to FIGS. 1 to 3 and 5, the turning axle means 9 are fixed in the legs 13 of the actuating bow 5 by axle securing parts 12. The turning parts 7 are pivotably mounted by pins 14 in bores 15 of the stamp housing 4, and they carry inner pins 16 engaging in lateral guiding grooves 17 of the type unit 3 for the turning of the type unit 3 during its downward movement with the help of the bow 5 and the turning axle means 9 (see FIGS. 4 and 5).

By means of a spring 18, in particular a helical compression spring (see FIG. 5), which is supported on the upper side of the stamp housing 4, the actuating bow 5 is pressed in a conventional manner into its upper resting position illustrated in FIGS. 1 to 3 and 5 to 7, and it is downwardly movable relative to the stamp housing 4 against the force of said spring 18. The spring 18 is accommodated in a tubular part 19 which extends into a handle 21 mounted on the upper side of the actuating bow 5, on the transverse part or web 20 thereof, the handle 21 and the tubular part 19 being telescopically moved within each other during actuation of the stamp 1.

According to FIGS. 1 to 3, on the stamp housing 4, furthermore a text inspection window 22 of angular design with a relatively large front area 22A and an upper cover surface 22B is attached, a slot-shaped recess 22C being provided in the upper cover surface 22B so as to be able to slip on the inspection window 22 during attachment on the stamp housing 4, in particular—as is known per se—by snapping on, despite the tubular part 19, said tubular part 19 in its mounted position being received in this recess 22C, as best visible in FIG. 2. A comparably angularly designed small text card (not shown) having an upper, rear slot may be inserted into the inspection window 22 and can be fixed together therewith at the upper part of the stamp housing by putting it on the upper side thereof as well as by engaging the inspection window 22 with the upper part of the stamp housing.

Finally, as an example, from FIG. 1 there is also visible a push-button snap-in element 26 provided on the bow 5, said push-button snap-in element 26 cooperating with notches 27 on the tubular part 19 so as to enable the fixing of the actuating bow 5 in a predetermined position relative to the stamp housing 4, as is known per se.

Figure 4:
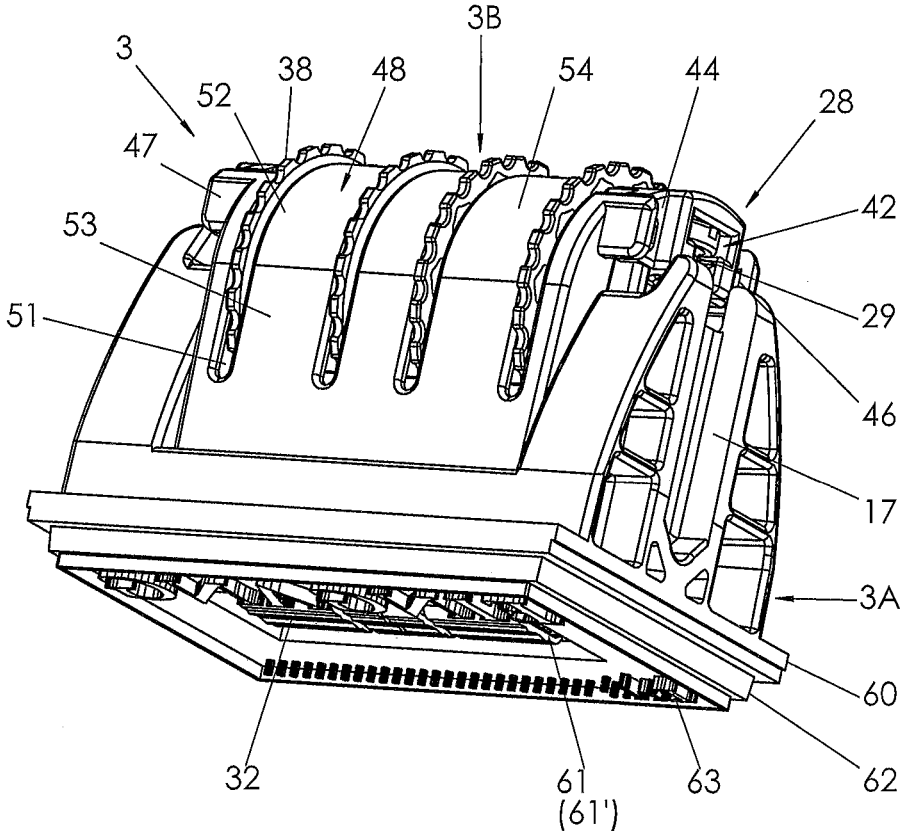
FIG. 4 shows a perspective view of an example of a type unit as it may be used with such a self-inking stamp according to FIGS. 1 to 3.

As can be seen from FIG. 4, the type unit 3 comprises two type unit parts 3A, 3B, namely a first, outer type unit part 3A which in view is U-shaped and is also referred to as a base part or a text plate body, as well as also a second, inner type unit part 3B comprising a bearing part 28 which is fixed at the base part 3A by the help of set screws 29 in a manner that it can be adjusted in its vertical position relative thereto. The bearing part 28 preferably is designed as a one-piece injection molded part having two side portions 30 and a support bar 31 connecting these side portions 30, cf. FIG. 5, said support bar 31 serving to support type bands 32 (for instance four type bands 32, for adjusting a date to be imprinted). In this connection, the type bands 32 each extend over an associated drive wheel 33, 34, 35, 36 (see FIG. 5), each of said drive wheels 33 to 36 having wheel bodies with a toothed-wheel-type profile at its circumference, as well as an adjustment wheel 38 which preferably is integrally connected thereto. The drive wheels 33 to 36 are rotatably mounted in the bearing part 28 with the help of a—e.g. two-part (see FIG. 5)—axle 39 so as to be able to manually set the type bands 32 with the help of the adjustment wheels 38 of the drive wheels 33 to 36 to the desired date, or, in general, to the desired imprint.

The set screws or adjustment screws 29 are screwed into thread receptacles or seats 40 of the base body 3A that have a female thread (see FIG. 5), and the heads 41 of the set screws 29 are received in laterally open receptacles or seats 42 (see FIG. 4) on the two front sides of the bearing part 28, and, during mounting therefor, they are each at first pushed into these receptacles 42 from the side through a slot provided in a bottom, until the shaft of the set screws 29 is located far enough inwardly so as to fit into the respective thread receptacle 40 of the base part 3A. The upper side of the screw head 41 of the respective set screw 29 is then accessible through an opening 43 (see FIG. 6) of the receptacle 42 for a tool, in particular a screwdriver (not shown), in order to carry out the required fixing and fine adjustment.

According to FIG. 4, the receptacles 42 are formed at the two front sides of the bearing part 28, on the outer sides thereof, respectively, between two noses 44 of the bearing part 28, wherein each pair of such noses 44 is arranged in a mirror-inverted fashion, and, otherwise, practically the same design is provided for all the noses. Said noses 44 form snap-in elements 46 (and, consequently, are also denoted as snap-in projections 44), and these snap-in projections 44 cooperate with correspondingly designed, co-operating snap-in elements 47 provided on a hood-shaped type band cover 48 (see FIG. 4). In detail, the snap-in elements 47 of the cover 48 are formed by cone-shaped projections provided on carrying-part extensions (not shown) which project at the two front sides of the cover 48.

As has already been mentioned, the cover 48 is hood-shaped and has a configuration of a U-shaped cross-section, and it has slots 51 for the adjustment wheels or adjustment disks 38 of the drive wheels 33 to 36. These slots 51 extend from one upper arcuate region 52 of the cover 48 into the region of legs 53 of the cover 48. The sections 54 between the slots 51 cover the type bands 32 in the mounted position, see in particular FIG. 4, whereby it is avoided that, during the adjustment of the type bands 32 via the drive wheels or their adjustment disks 38, respectively, the fingers of the user will become soiled with stamping ink by unintentionally contacting the type bands 32. The cover 48 may be fastened by snap-in engagement on the bearing part 28 in a simple manner with the help of the snap-in projections 44, and then can also be detached again from the bearing part 28 of the type unit 3 without any problems. Furthermore, when adjusting the bearing part 28 relative to the base part 3*a*, the cover 48 is automatically co-adjusted, since it is mounted on the bearing part 28—and not on the base part 3A.

As is furthermore visible in particular in FIG. 4, the base part 3A has an—according to the illustration lower—frame part 60, with a passage opening 61 for the types of the type bands 32, which types are each supported by the support bar 31, respectively, when making a stamp imprint; to this frame part 60 there is fastened a rectangular plate 62 with a corresponding passage opening 61' for the types of the type bands 32, for instance by gluing. This plate 62 consists of synthetic or natural rubber, for instance with a Shore A hardness of from 50 to 55, and it is provided with stationary stamp types 63 visible in FIG. 4.

The self-inking stamp 1 described so far, with the double type unit 3, is of a construction which is conventional per se, and for a supplementary explanation reference may be made to WO 2006/079129 A1 already mentioned at the beginning. In the self-inking stamp according to said prior art, as a turning axle means 9 there is provided a single, continuous turning axle extending from one of the bow legs 13 through a slot 11 in the stamp housing 4 and further on through both parts of the type unit 3 through to the slot opening 11 on the other side of the stamp housing 4 and finally through the opening 10 in the bow leg 13 on the other side of the stamp 1. If, in case of such a concept, for instance the type unit part 3B which lies at the inside is to be dismounted, wherein the outer type unit part 3A shall remain in place, nevertheless the entire type unit 3 has to be removed from the stamp housing 4, wherein, therefor, first the continuous turning axle has to be removed which requires the releasing of the axle securing elements, as for instance of the axle securing elements 12 according to FIGS. 1 to 3. A special tool is required therefor, and the dismounting is comparatively complicated.

Figure 5:
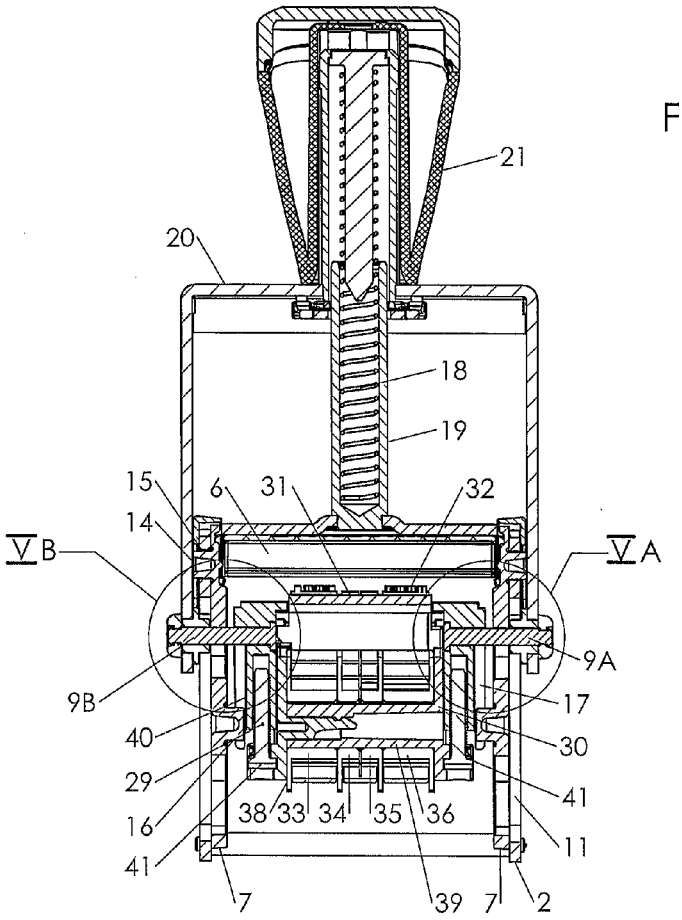
FIG. 5 shows a longitudinal section through a comparable self-inking stamp approximately along line V-V in FIG. 3, wherein the special split design of the turning axle means is visible.
Figure 7:
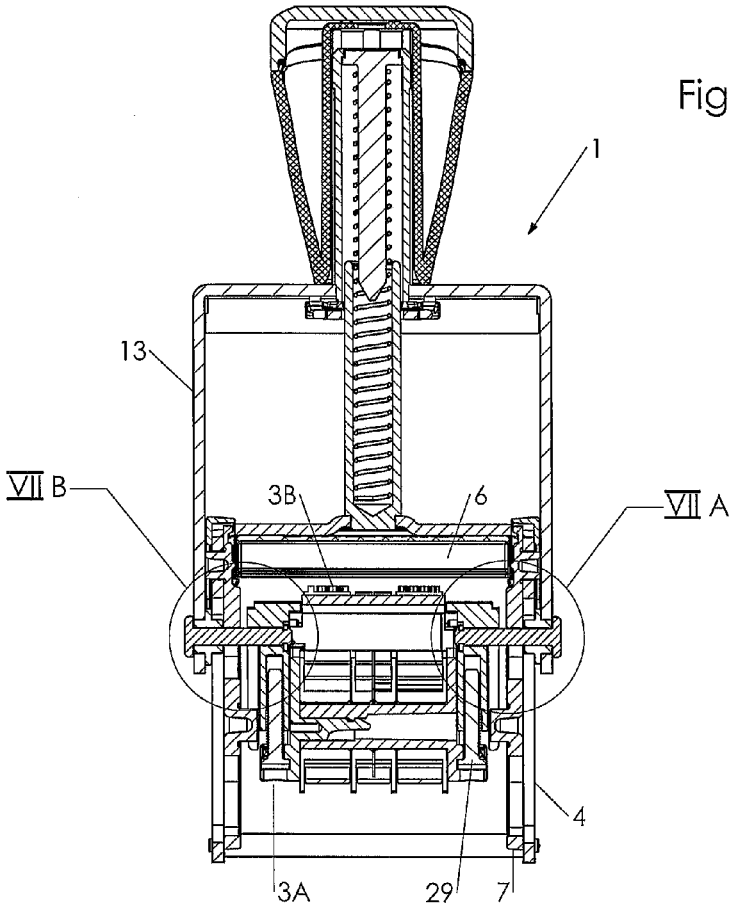

According to the embodiments as represented in FIGS. 5, 6, and 7, now it is departed from the former design with the single, continuous turning axle (which, per se, in view of just one component that has to be mounted, seems to be advantageous a priori), and the turning axle means 9 are formed by two separate, lateral axle elements 9A, 9B, as is visible in FIGS. 5 to 7 (including 5A, 5B; 6A, 6B; and 7A, 7B). Between the inner ends of said axle elements 9A, 9B there is provided a receiving space 65 for the inner type unit part 3B within the outer type unit part 3A, see in particular FIG. 6. This renders possible—as is directly visible from FIGS. 5, 6, and 7—that the inner type unit part 3B, i.e. in particular the date holder, can be dismounted and exchanged e.g. for another inner type unit part 3B by simple unscrewing the screws 29 of the inner type unit part 3B, with the type unit 3 being mounted as a whole within the stamp housing 4.

It is also to be noted here that the general construction of the stamp, although comprising the split turning axle 9A, 9B, according to FIGS. 5, 6, and 7 is basically identical and corresponds substantially to the stamp according to FIGS. 1 to 4, so that repetitions of descriptions of for instance the stamp housing 4, the actuating bow, the turning mechanism 2, etc. are not necessary. The above general explanations apply in a corresponding manner to all embodiments of self-inking stamps according to FIGS. 5, 6, and 7 in the same manner. Differences are only given with regard to the kind of the design or arrangement and with regard to the mounting of the axle elements 9A, 9B in FIGS. 5 to 7.

Figure 5B:
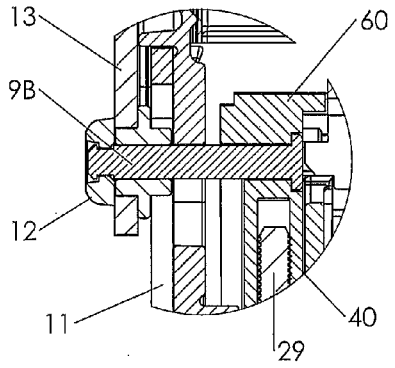
FIG. 5A and FIG. 5B show details VA or VB from FIG. 5 for a better illustration of the axle elements of the turning axle and of their arrangement.
Figure 5A:
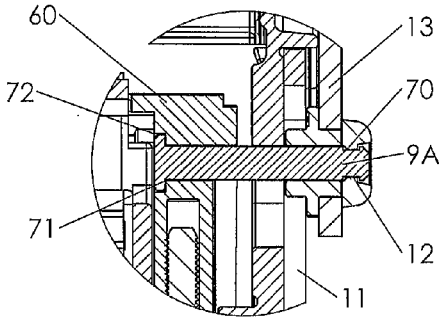

According to FIG. 5, in this connection in particular also according to FIG. 5A and FIG. 5B, the two axle elements 9A, 9B, at their outside, are each secured by means of retaining rings 12, in a similar manner as in the case of the self-inking stamp according to FIGS. 1 to 3. As is best visible in FIG. 5A and FIG. 5B in more detail, the retaining rings 12 protrude with a narrower radial projection, into a recess, into a groove 70, at the circumference of the respective axle element 9A, 9B, wherein a kind of a locking or engagement of the retaining ring 12 at the axle element 9A, 9B is given. At the inside, the axle elements 9A, 9B have a radial stop projection 71, here in the form of a collar or shoulder 71 extending along in the circumferential direction. Said collar 71 is provided in a lateral recess 72 in the region of the text plate frame part 60 or of the regions adjacent thereto, with the thread receptacle 40, as can be directly seen in FIGS. 5A and 5B. It shall be mentioned here, however, that in FIGS. 5 and 5A, 5B (and also in FIGS. 6 and 7) no (stationary) print types (stamp types) are visible at the frame 60, and that also the frame 62 as represented in FIG. 4 has been omitted. Normally, in fact, in said small-side regions of the text plate 60 there are no print types, cf. also FIG. 4. Accordingly, also in the representation according to FIG. 5 the types of the type bands 32 protrude when compared with the text plate frame 60.

In the embodiment according to FIGS. 5, 5A, and 5B, the mounting of the axle elements 9A, 9B is carried out from the inside, wherein the axle elements 9A, 9B will be finally fixed at the outside of the bow legs 13 with the help of the above-mentioned retaining rings 12.

In the embodiments according to FIGS. 6 and 7, however, the mounting of the axle elements 9A, 9B is carried out from the outside, respectively. Here, the axle elements 9A, 9B in the embodiment according to FIG. 6—and also in the one according to FIG. 7—, are for instance identical to the ones according to FIG. 5, with the only difference that the axle elements 9A, 9B are mounted from the outside, respectively, i.e. that they are pushed through the bow legs 13, the stamp housing 4 and the outer type unit part 3A. In this case, the stop projection or the collar 71 abuts at the outside of the actuating legs 13, respectively, as is visible in FIGS. 6 and 7.

In the embodiment according to FIG. 6, in the inside a retaining lug 73 snaps in into the annular groove 70 of the axle elements 9A, 9B. Thereby a lock or a snap-in connection, which is generally designated with 73', is given between axle element 9A, 9B and text plate frame 60.

Furthermore, in the case of FIG. 5 to FIG. 7, the respective axle element 9A, 9B is supported in the respective bow leg 13 with the help of a bearing bush 74, said bearing bush 74 comprising an axial, annular flange 75 serving as a spacer between the bow leg 13 and the housing 2, see FIGS. 6A, 6B. Such a bush arrangement is also provided in the embodiments according to FIGS. 5 and 7, but is not additionally described therein for the sake of simplicity.

Figure 7B:
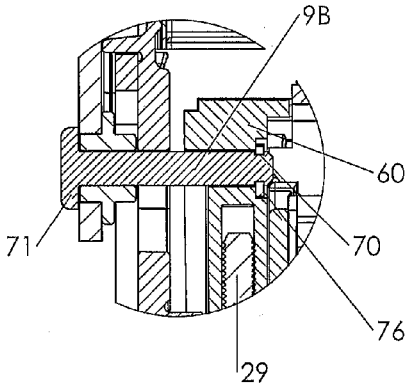
Figure 7A:
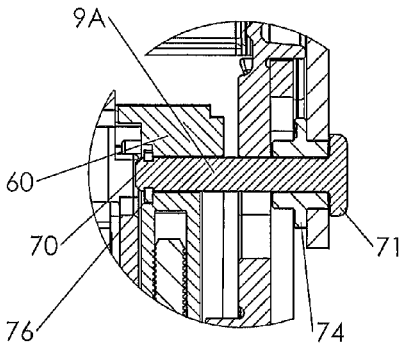

In the embodiment according to FIGS. 7, 7A, 7B, the axle elements 9A, 9B are axially secured at their inner ends 5—where, once again, an annular groove 70 is provided which is visible in FIGS. 7A, 7B—with the help of retaining washers or retaining rings 76 engaged in said annular groove 70 and abutting at the inside of the outer type unit part 3A in the region of a recess similar to the recess 72 in FIGS. 5A and 5B. On the other hand, each axle element 9A, 9B abuts again in the bow leg 13 with an annular collar 71, and a bearing bush 74 is also provided.

In the embodiments according to FIGS. 6 and 7, the inserted axle elements 9A, 9B will be secured at the inside of the outer type unit part 3A by locking or by snapping-on of the retaining washers 76, and then the inner type unit part 3B will be mounted with the help of screws 29, as already described.

Although the invention has been described above in particular by means of various exemplary embodiments, further variations and modifications thereof are possible within the scope of the invention. Theoretically, different mounting forms, as explained by means of FIGS. 5, 6, and 7, can be combined in one and the same self-inking stamp. The axle elements 9A, 9B can be made of steel, but they can also be made of a correspondingly hard plastic.

What is claimed is:

1. A self-inking stamp comprising:

a stamp housing;

an actuating bow that is upwardly and downwardly displaceable relative to the stamp housing; and a type unit coupled via a turning axle to the actuating bow and arranged for movement between an upper inking position when the type unit is in contact with an ink pad and a lower printing position turned by 180° via a turning mechanism;

wherein the type unit comprises a bow-shaped outer type unit part and an inner type unit part arranged within the outer type unit part;

wherein the inner type unit part is accommodated in an inner receiving space in the outer type unit part and is releasably connected to the outer type unit part; and wherein the turning axle comprises separate first and second outer axle elements, each outer axle element extending through an opening in an actuating bow leg of the actuating bow, through a slot in the stamp housing to and into the outer type unit part and being connected to the outer type unit part.

2. The self-inking stamp according to claim 1, wherein at least one of the first and second axle elements has an outer, radial stop projection abutting externally at the actuating bow leg.

3. The self-inking stamp according to claim 2, wherein the stop projection is formed by a collar.

4. The self-inking stamp according to claim 1, wherein at least the first axle element is engaged in a region of an inner end of the first axle element with the outer type unit part.

5. The self-inking stamp according to claim 1, wherein at least the first axle element, in a region of an inner end of the first axle element, is secured to the outer type unit part via a retaining washer accommodated in an annular groove in the first axle element and abutting internally at the outer type unit part.

6. The self-inking stamp according to claim 1, wherein at least one of the first and second axle elements has an inner, radial stop projection abutting at the inside of the outer type unit part.

7. The self-inking stamp according to claim 6, wherein the stop projection is formed by a collar.

8. The self-inking stamp according to claim 1, wherein at least the first axle element, at an outer end of the first axle element, is secured via a retaining ring abutting externally at the actuating bow leg of the actuating bow and being accommodated within an annular groove in the first axle element.

9. The self-inking stamp according to claim 1, wherein the outer type unit part has stationary print types.

10. The self-inking stamp according to claim 1, wherein the inner type unit part has at least one adjustable type band.

* * * * *